US010034562B2

(12) United States Patent
Kumar

(10) Patent No.: US 10,034,562 B2
(45) Date of Patent: Jul. 31, 2018

(54) ART FRAME SUPPORT SYSTEM

(71) Applicant: Lokendra Kumar, Union City, CA (US)

(72) Inventor: Lokendra Kumar, Union City, CA (US)

( * ) Notice: Subject to any disclaimer, the term of this patent is extended or adjusted under 35 U.S.C. 154(b) by 59 days.

(21) Appl. No.: 15/145,754

(22) Filed: May 3, 2016

(65) Prior Publication Data

US 2016/0324341 A1 Nov. 10, 2016

Related U.S. Application Data

(60) Provisional application No. 62/156,750, filed on May 4, 2015.

(51) Int. Cl.
*A47G 1/00* (2006.01)
*A47G 1/08* (2006.01)

(52) U.S. Cl.
CPC ..... *A47G 1/08* (2013.01)

(58) Field of Classification Search
CPC ..... A47G 1/10; A47G 1/08
See application file for complete search history.

(56) References Cited

U.S. PATENT DOCUMENTS 996,915 A 7/1911 Engelmohr
2,776,508 A 1/1957 Hutson
2,790,259 A * 4/1957 Havens ..... A47G 1/08 40/741
2,866,286 A 12/1958 Hartman
2,947,391 A * 8/1960 Wayne ..... A47G 1/10 40/782
3,465,461 A 9/1969 Price et al.
4,477,990 A 10/1984 Buchanan
(Continued)

FOREIGN PATENT DOCUMENTS

CN 2412766 Y 1/2001

*Primary Examiner* — Charles A Fox
*Assistant Examiner* — Christopher E Veraa
(74) *Attorney, Agent, or Firm* — Morrison & Foerster LLP

(57) ABSTRACT

A frame assembly system is disclosed. In some examples, the frame assembly system comprises a plurality of joining pieces having a plurality of openings in each joining piece, each of the plurality of openings having a first cross-sectional shape and framing pieces having a second cross-sectional shape, different from the first cross-sectional shape, wherein the first cross-sectional shape can be formed by an arrangement of two or more of the framing pieces, a first one of the two or more framing pieces positioned approximately perpendicular to at least a second one of the two or more framing pieces in the arrangement. In some examples, four joining pieces form four corners of a rectangular frame, and at least eight framing pieces form four sides of the rectangular frame. In some examples, the first cross-sectional shape is a T shape and the second cross-sectional shape is rectangular. In some examples, the first cross-sectional shape is an L shape and the second cross-sectional shape is rectangular. In some examples, the frame assembly system further comprises a fastener for coupling at least one of the framing pieces to at least one of the joining pieces and a cap piece couplable to at least the at least one joining piece and configured to conceal the fastener.

15 Claims, 13 Drawing Sheets

(56) References Cited

U.S. PATENT DOCUMENTS

| | | | | | |
|---|---|---|---|---|---|
| 4,662,092 | A * | 5/1987 | Kim | A47G 1/10 | 40/784 |
| 4,729,183 | A | 3/1988 | Tarter et al. | | |
| 4,827,648 | A | 5/1989 | Danin | | |
| 4,862,612 | A | 9/1989 | Sugihara et al. | | |
| 4,986,013 | A | 1/1991 | Pollack | | |
| 5,187,886 | A | 2/1993 | Wu et al. | | |
| 5,579,596 | A | 12/1996 | Kovacs et al. | | |
| 5,819,458 | A * | 10/1998 | Hadden | A47G 1/0605 | 40/700 |
| 6,377,320 | B1 | 4/2002 | Ananian et al. | | |
| 6,865,836 | B2 | 3/2005 | Sachs-Lavery | | |
| 2010/0043268 | A1* | 2/2010 | Powell | A47G 1/10 | 40/741 |
| 2011/0023345 | A1* | 2/2011 | Ellingson | A47G 1/0627 | 40/714 |
| 2014/0068984 | A1* | 3/2014 | Mochel | A47G 1/06 | 40/731 |

* cited by examiner

ART FRAME SUPPORT SYSTEM

CROSS REFERENCE TO RELATED APPLICATION

This application claims the benefit under 35 U.S.C. § 119(e) of U.S. Provisional Patent Application No. 62/156,750, filed May 4, 2015, the content of which is incorporated by reference herein in its entirety for all intended purposes.

FIELD OF THE DISCLOSURE

This invention relates broadly to frames for pictures, paintings, drawings, or the like. More particularly, this invention relates to adjustable size and shape frames.

BACKGROUND OF THE DISCLOSURE

FIG. 1 illustrates an art frame 100 according to examples of the disclosure. In some examples, the art frame 100 can include frame members 102 and 104. In some examples, frame members 102 can be oriented in a vertical direction, and frame members 104 can be oriented in a horizontal direction. In some examples, ends of the frame members 102 and 104 can be angled at 45 degrees such that the frame members can be aligned to form a rectangular frame with a rectangular opening 106 for displaying pictures, paintings, or the like. Frame members 102 and 104 can be fixed together with staples, nails, or the like. Once fixed together, frame 100 can have a fixed overall size, shape, and aesthetic appearance. Frame members can be made from various materials such as wood, metal, plastic etc. An art frame and frame support system that can provide both a variable size and varied aesthetic appearance for displaying pictures, paintings, or the like according to examples of the disclosure will be described in detail below.

DETAILED DESCRIPTION

Figure 1:
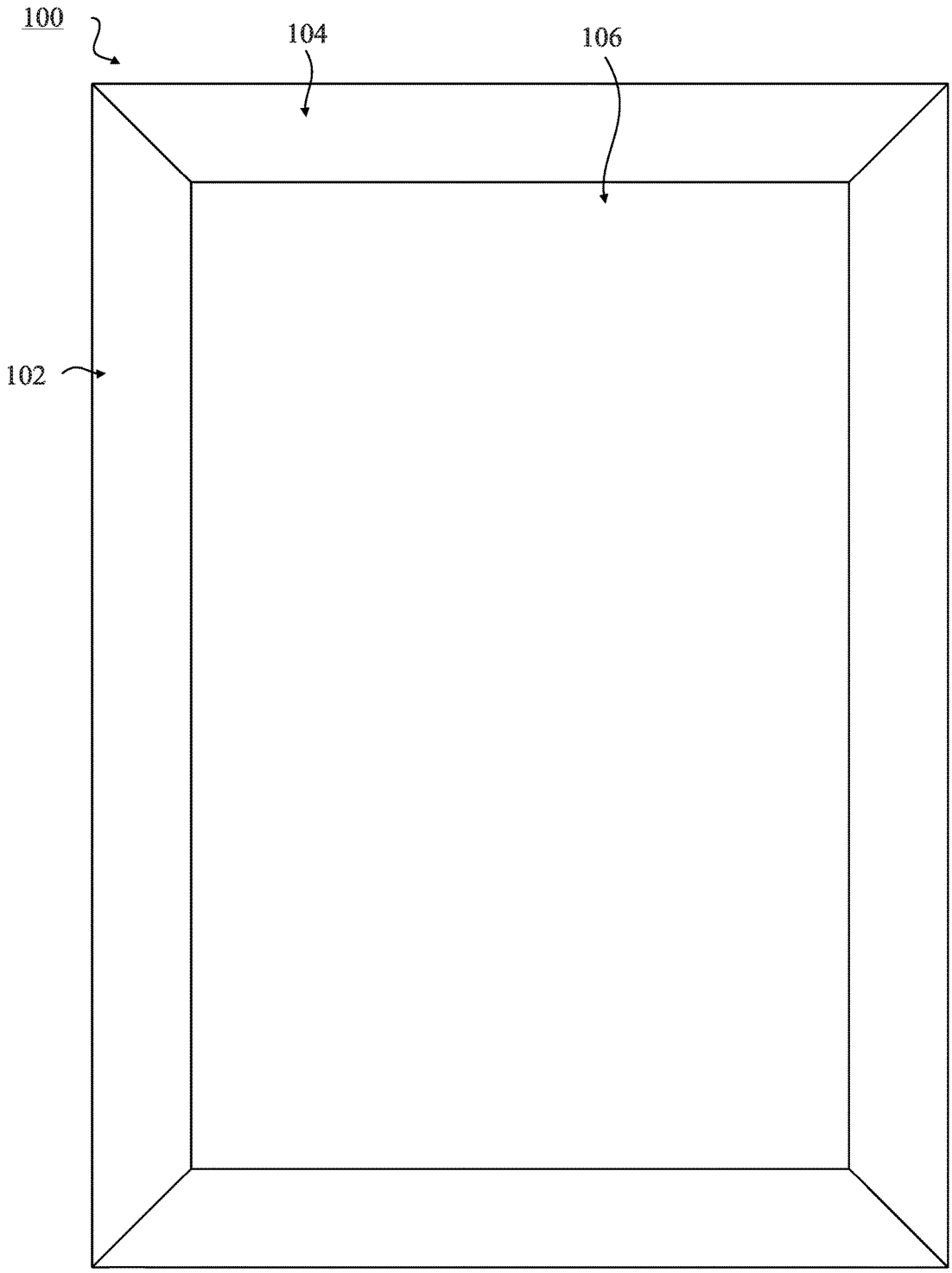
FIG. 1 illustrates a conventional art frame according to examples of the disclosure.
Figure 2A:
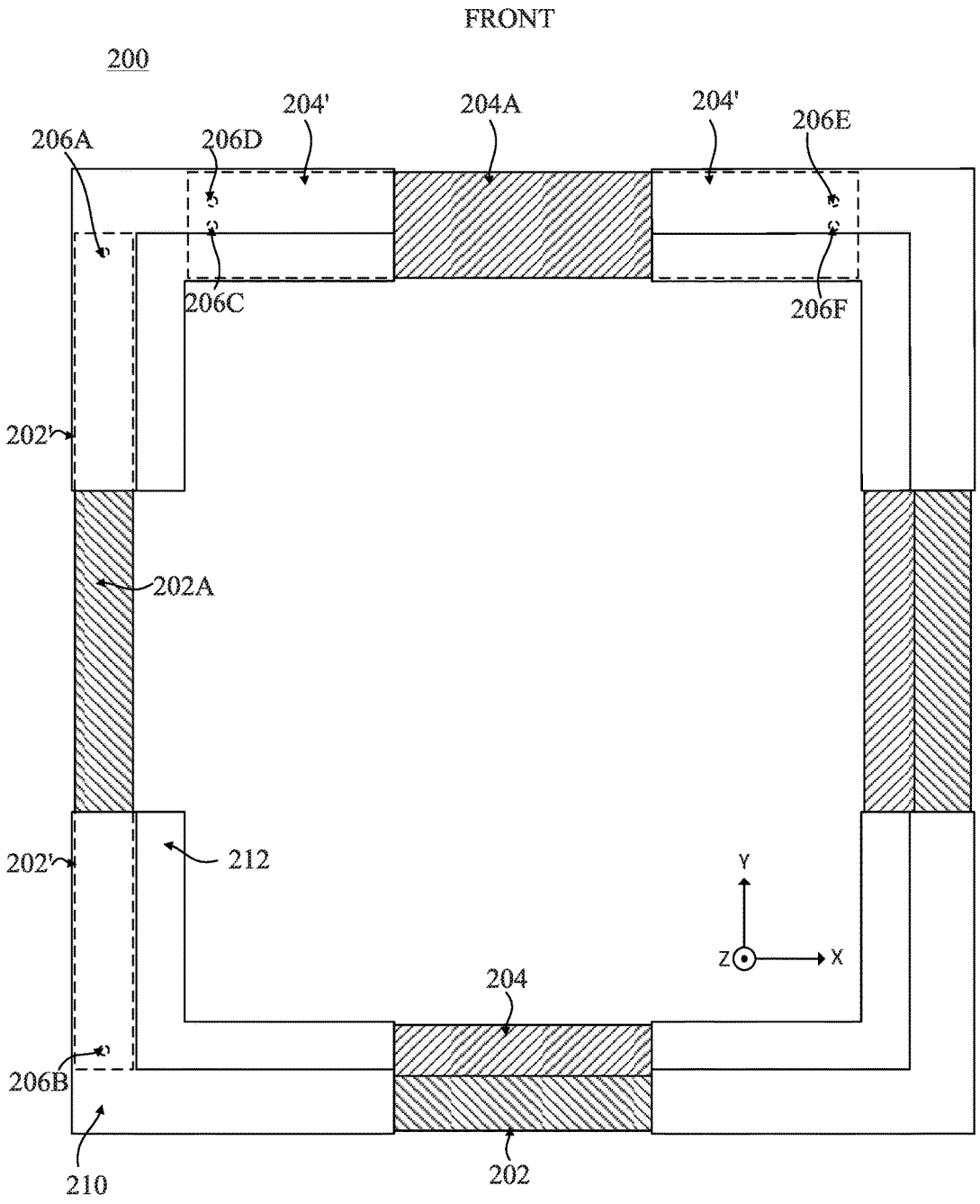
FIGS. 2A-2B illustrate front and back facing views of an exemplary L shaped art frame support system according to examples of the disclosure.
Figure 2B:
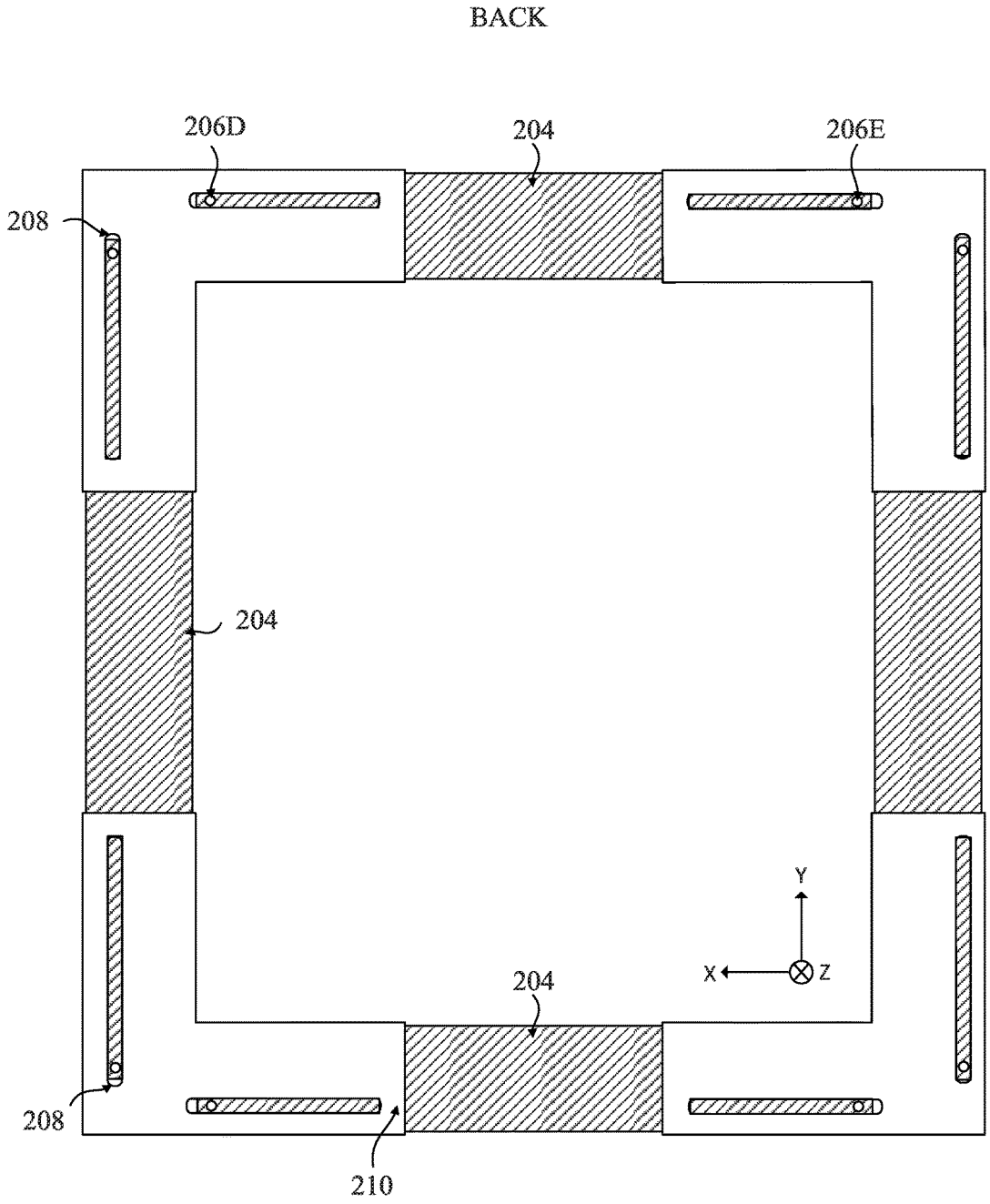

FIGS. 2A-2B illustrate an exemplary art frame support system 200 according to examples of the disclosure. Various examples of an art frame system 200 can be used for making an art frame for art display of various forms like paintings, drawings, photographs and murals. The principles of an art frame support system 200 can be used to create other art forms, such as sculpture, art furniture, and other art utilities as well as purely functional furniture pieces, for example. FIG. 2A illustrates an exemplary view facing the front of frame support system 200, and FIG. 2B illustrates an exemplary view facing the back of the frame support system. As illustrated in FIG. 2A, art frame support system 200 can comprise edge pieces 202 and 204 for forming a border around a piece of art or a photograph. Corner pieces 210 can be configured to receive edge pieces 202 and 204 within a cavity of the corner piece. In some examples, the corner pieces 210 can include a cavity having an L shaped cross-section (illustrated in greater detail in FIGS. 4 and 7 below). In some examples, four sets of vertical edge pieces 202 and four horizontal edge pieces 204 (e.g., eight edge pieces in total) and four corner pieces 210 can be assembled into a rectangular frame. In some examples, vertical edge pieces 202 and horizontal edge pieces 204 can be configured to fit together within the cavity in corner pieces 210. In some examples, vertical edge pieces 202 and horizontal edge pieces 204 can have each have a rectangular cross section (or optionally can have other cross-sections that can correspond to a shape of a cavity in the corner pieces 210). In some examples, the vertical edge pieces 202 can have a long side along the Z axis (for all sides of the frame) and horizontal edge pieces 204 can have a long side along the X axis (for the left and ride sides of the frame) or Y axis (for the top and bottom sides of the frame), as further illustrated in FIG. 4. In some examples, vertical edge pieces 202 can be arranged approximately perpendicular (e.g., within normal manufacturing tolerances) to, aligned with (e.g., forming a desired shape), and in contact with, horizontal edge pieces 204 to form the top, bottom, left, and right sides of a frame. In some examples, vertical edge pieces 202 and horizontal edge pieces 204 can be arranged to form an L shape corresponding to the L shape of the cavity (further illustrated in FIGS. 4 and 7 below) in corner 210 described above. It should be understood that in order to fill the corners 210, both vertical edge pieces 202 and horizontal edge pieces 204 can be inserted into each opening of each corner piece. However, for purposes of illustration, in FIG. 2A, the left vertical edge piece 202A is shown without a corresponding left horizontal edge piece 204 to show that the short edge of vertical edge piece 202A can be significantly narrower than the overall width of corner pieces 210. Inserted portions 202' of edge piece 202A are illustrated with dotted lines to show an exemplary amount of insertion of the edge piece 202A into the cavity of corner piece 210. Similarly, edge piece 204A is shown without a corresponding edge piece 202 to show that the longer edge of the horizontal edge pieces 204 can be longer than the short edges of vertical pieces 202, for forming an overall L shape for the sides of the frame, which can correspond to the shape of corner piece 210. Similarly, inserted portions 204' of edge piece 204A are illustrated with dotted lines to show an exemplary amount of insertion of the edge piece 204A into the cavity of corner pieces 210. As illustrated in the configuration of FIGS. 2A and 2B, the inserted portions 202' and 204' can be inserted deeply into the cavities of corner pieces 210 such that more than half of the total length of each of the edge pieces 202 and 204 is contained within the corner pieces 210. It should be well understood by persons skilled in the art that maximum and minimum amounts of insertion for the edge pieces 202 and 204 will can be limited by relative dimensions of the edge pieces and corner pieces 210, as well as considerations regarding stability (e.g., rigidity) of the assembled frame. When the edge pieces are inserted into corner pieces, a ledge 212 in the corner pieces 210 can form an internal support area for an art piece, photograph, or the like. As illustrated in FIGS. 2A and 2B, one configuration of the art frame support system 200 can have an approximately square shape. As will be illustrated below in FIGS. 3A-3B, the frame support system 200 can be reconfigured with a different shape (e.g., rectangular).

Fastener attachment points 206 can be included in vertical edge pieces 202 (e.g., 206A-206B) and horizontal edge pieces 204 (e.g., 206C-206F) for adjustably securing edge pieces 202 and 204 together in different configurations (as will be shown in more detail below). In some examples, a fastener (e.g., a screw) can be threaded into fastener attachment points 206 for securing horizontal edge pieces 204 to vertical edge pieces 202, which can secure the L shape arrangement of edge pieces 202 and 204 within the L shape cavity of the corner piece 210. In some examples, a threaded insert (e.g., a dual threaded metal insert) can be inserted in fastener attachment points 206, to prevent wear of the material of edge pieces 202 and 204 from repeated insertion and removal of a fastener (e.g., a screw).

As shown in the back side view of the art frame assembly system 200 in FIG. 2B, in some examples, connection slots 208 can be formed on a portion of the back side of corner pieces 210. Connections slots 208 can be used to allow for adjustable attachment of the edge pieces 202 and 204 with varying amounts of insertion (e.g., 202' and 204') through connection holes (e.g. 206A-206F) to secure the edge pieces and corner piece 210 together. For example, a screw fastener can pass through a connection slot 208, and attach edge pieces via appropriate screw holes (i.e., fastener attachment points) 206A-206F. Although fastener attachment points 206 are described as screw holes and continuous oval shaped slots 208 are illustrated in FIG. 2B, it should be understood that other mechanical configurations can be used to secure the edge pieces and corner pieces together. For example, instead of one continuous slot 208, two or more holes can be provided for fixing edge pieces 202 and 204 and adjusting the size of the frame. Accordingly, the amount of insertion of edge pieces 202 and 204 into corner pieces 210 can be variable continuously over a range of positions or variable over a limited number of positions. For the illustrated L shaped configuration of the art frame system 200, it can be seen that fastener attachment points 206D and 206E of the horizontal edge pieces 204 can be aligned with the slots 208. As will be shown below, when different corner pieces (e.g., corner pieces 510 below) are used, fastener attachment points 206C and 206F of horizontal frame can be aligned with slots 208, and the art frame system can have a different shape (e.g., a T shape). The amounts of insertion 202' and 204' can be varied for both top/bottom and left/right edges according to the size of the art piece, and secured to keep the art piece contained within the edges of the frame.

In some examples, corner pieces 210 can be manufactured using techniques such as 3D printing. Improvements in 3D printing technology allow for rapid creation of a piece such as the corner piece 210, having a cavity that can include a 90 degree angle to form the corner shape without requiring multiple machining steps to cut out a cavity, for example. In addition, corner pieces 210 can be constructed by more traditional techniques, such as casting (e.g., for metal corner pieces), tongue and groove assembly (e.g., for wood, plastic, or metal corner pieces), or other known manufacturing techniques utilizing suitable materials.

Figure 3A:
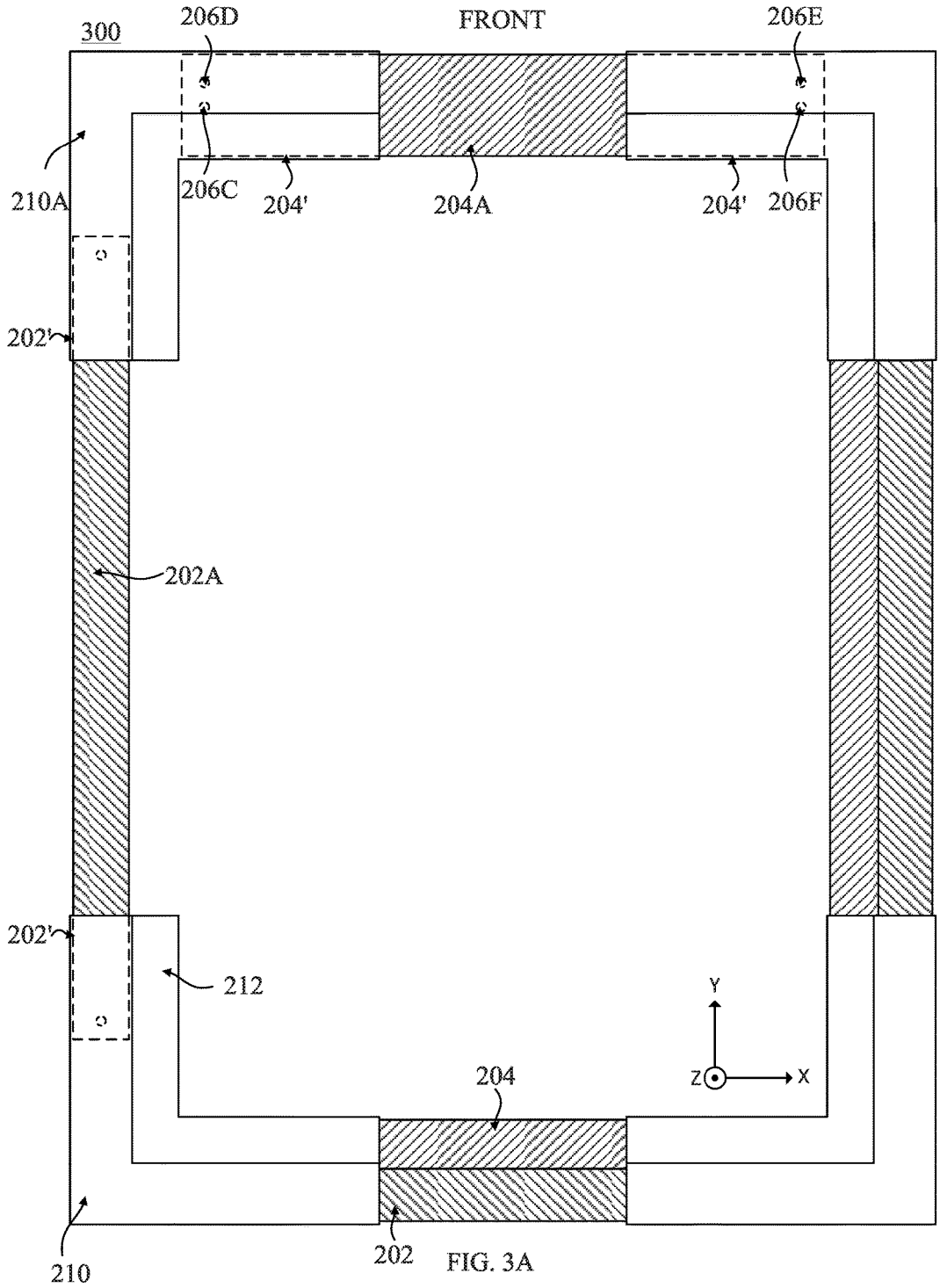
FIGS. 3A-3B illustrate front and back facing views of an alternate configuration of the exemplary L shaped art frame support system according to examples of the disclosure.
Figure 3B:
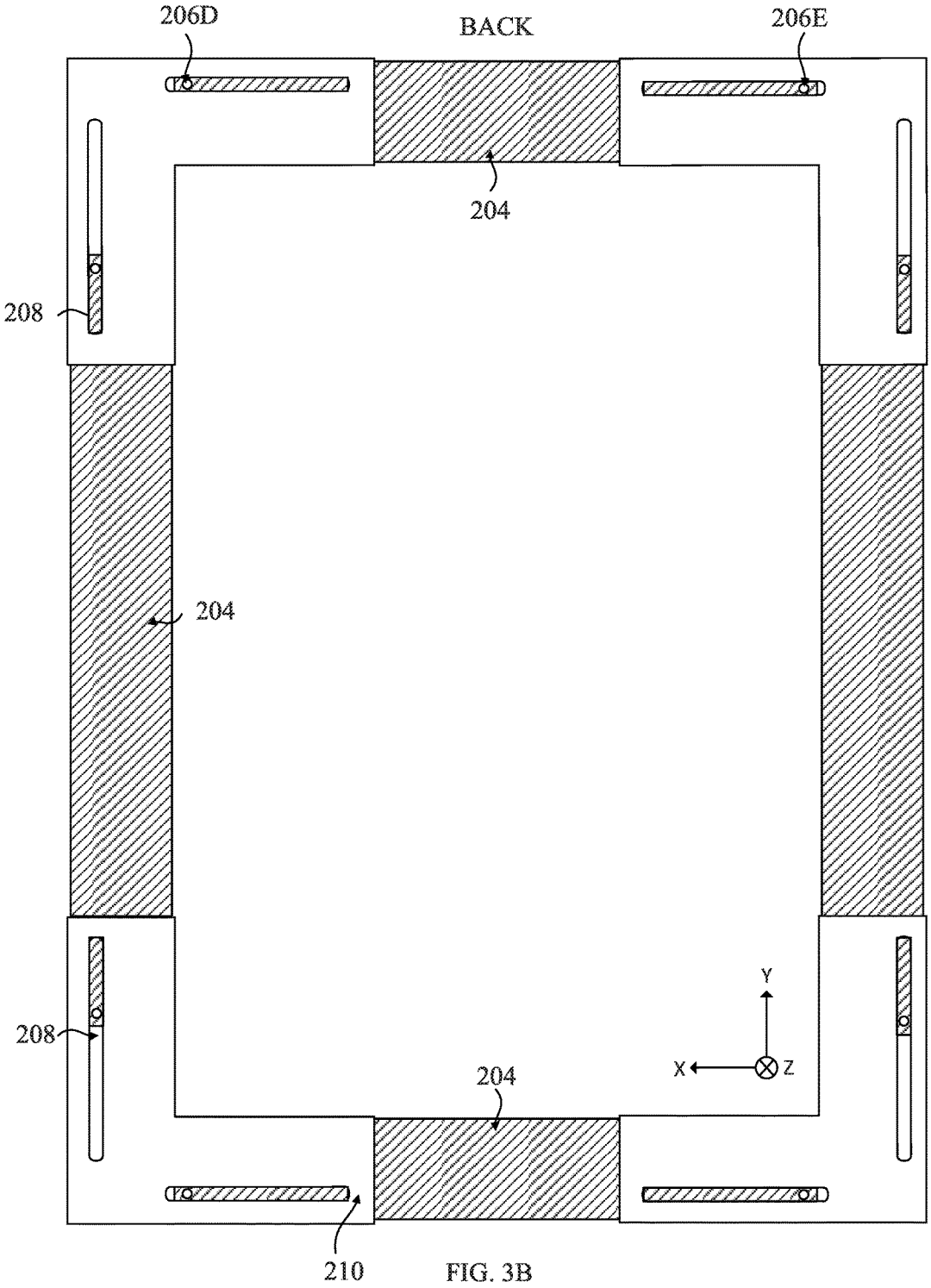

FIGS. 3A-3B illustrates an exemplary alternate configuration for an L shaped art frame support system 300 that can be an alternative configuration of art frame support system 200 according to examples of the disclosure. FIG. 3A illustrates a frontal view of the L shaped art frame support system 300. In particular, inserted portions 202' of vertical edge pieces 202 and (horizontal edge pieces 204) on the left and right sides of the frame can be positioned such that more of the edge pieces are exposed and less of the edge pieces are inserted in corner pieces 210. The amount of insertion 202' for one exemplary vertical edge piece 202A on the left side of the frame is illustrated in FIG. 3A. Similarly to FIG. 2A above, a corresponding horizontal edge piece 204 is omitted on the left side of the illustrated frame to more clearly show the insertion 202' of vertical edge piece 202A into corner pieces 210. In effect, the illustrated change in insertion amount 202' can increase the vertical (along the Y axis) dimension of the art frame 300 relative to the configuration of art frame support system 200 while using identical components. In other words, FIGS. 2A-2B and 3A-3B illustrate examples of the adjustable nature of the art frame support system (200 and 300) according to the disclosure. It should be easily understood from the figures that a similar adjustment can be made to the horizontal dimension of the art frame support system by changing the insertion amount (e.g., 204') of the edge pieces 202 and 204 along the top and bottom of the frame. The physical proportions shown are for the purposes of illustration, and it should be understood that different dimensions of the illustrated components can be used while remaining within the scope of this disclosure.

FIG. 3B illustrates a back side view of the art frame assembly system 300 wherein slotted openings 208 can allow the edge pieces 202 and 204 to be fixed (e.g., by a fastener) to the corner pieces 210 with differing amounts of insertion 202' and/or 204'. For example, decreasing the insertion amounts 202' can increase the height of the frame 300 (when compared with the insertion amounts 202' shown in FIGS. 2A and 2B). Similarly, decreasing the insertion amounts 204' can increase the width of the frame. Conversely, increasing the amounts of insertion 202' and/or 204' can decrease the size of the frame in the corresponding direction. Thus, the frame assembly can be reused for art of different sizes. While FIG. 3B illustrates a slotted channel 208 for allowing edge pieces 202 and 204 to be fixed to the corner pieces 210 with differing amounts of insertion 202', it should be understood that a variety of other configurations can be used, such as two or more spaced apart holes corresponding to two or more different amounts of insertion 202'. Accordingly, the amount of insertion can be variable continuously over a range of positions or varied over a limited number of configurations.

Figure 4:
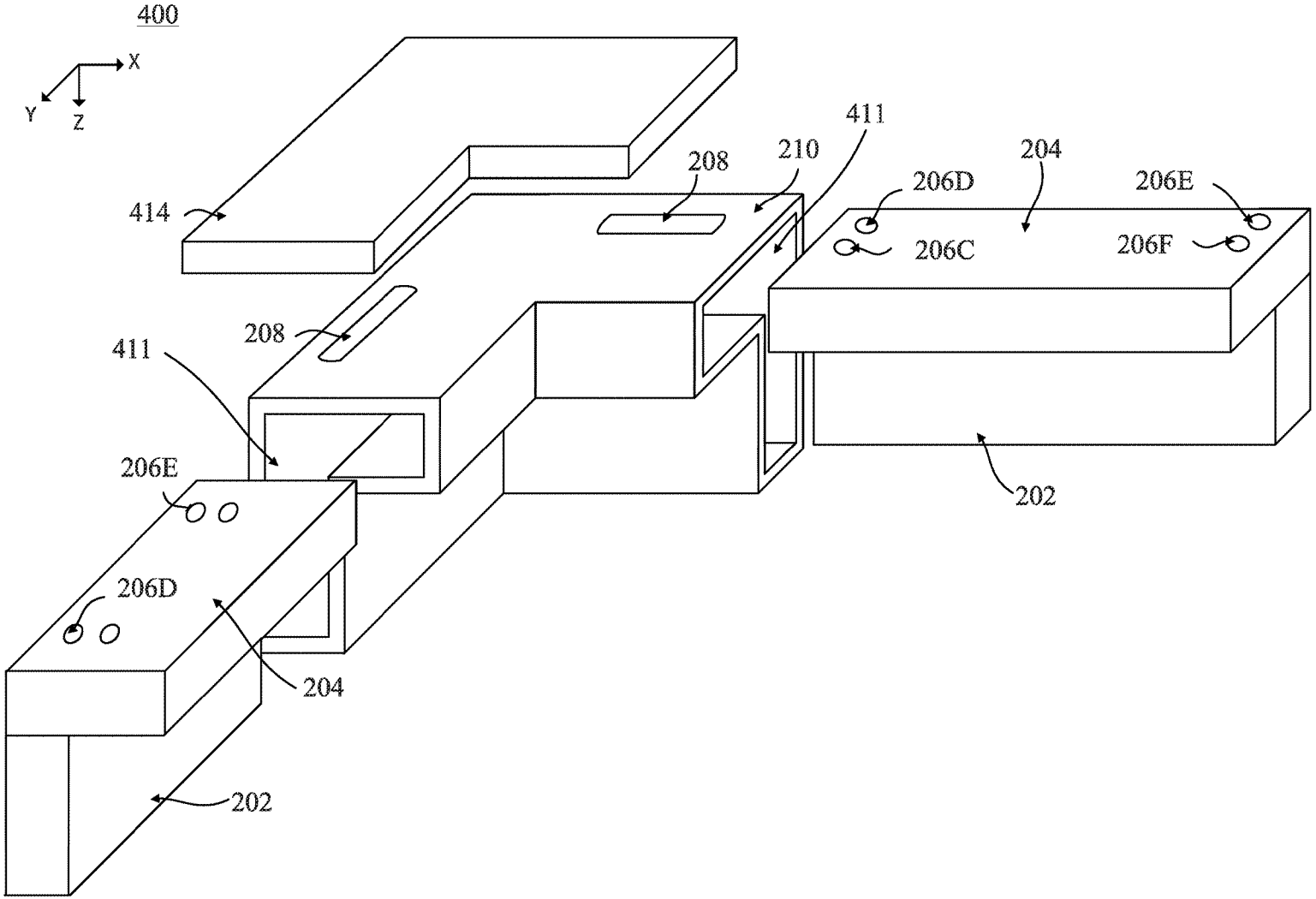
FIG. 4 illustrates an example perspective view of a portion of the exemplary L shaped art frame support system according to examples of the disclosure.

FIG. 4 illustrates a perspective view of art frame support system 400 incorporating L shaped corner 210 according to examples of the disclosure. Art frame components 202, 204, 206A-F, 208, and 210 can correspond to similarly referenced components in FIGS. 2-3. FIG. 4 illustrates an example of an L shaped cavity opening 411 in corner piece 210. In some examples, the cavity opening can have squared off edges with sharp corners. In some examples, the cross-sectional shape of edge pieces 202 and 204 can correspond to the shape of portions of the cavity opening (e.g., the cross-section of the edge pieces can have a rectangular shape) which can be referred to as an I shape. Further possible examples of L shaped cavity openings will be described in detail below (FIGS. 7A-7D). As illustrated, the edge pieces 202 and 204 can be positioned approximately perpendicular (e.g., within manufacturing tolerances) to one another such that they form an L shape. In some examples, slotted openings 208 can be aligned with attachment points 206 (e.g., 206D and 206E) in horizontal edge pieces 204 and through a corresponding attachment points 206 (e.g., 206A and 206B in FIGS. 2-3) of vertical edge pieces 202. In some examples, fasteners, such as screws, can be used for fixing the edge pieces 202 and 204 and the corner piece 210 together. In some examples, corner caps 412 can be affixed to corner pieces 210 to improve the visual appearance of the art frame by obscuring or hiding the fasteners holding the frame together. In some examples, corner caps 412 can snap into a groove (not shown) on the edge of the corner piece 210 including the slots 208 and can couple with the corner cap 412 to conceal the fasteners passing through slot 208 and respective attachment points 206. Thus, a pleasing aesthetic appearance can be maintained even when fasteners are used to hold the frame together. While only one corner 210 is shown, it is understood that similar assembly can occur with four corners (or more than four joining pieces as described below in FIG. 10) to form a frame.

Figure 5A:
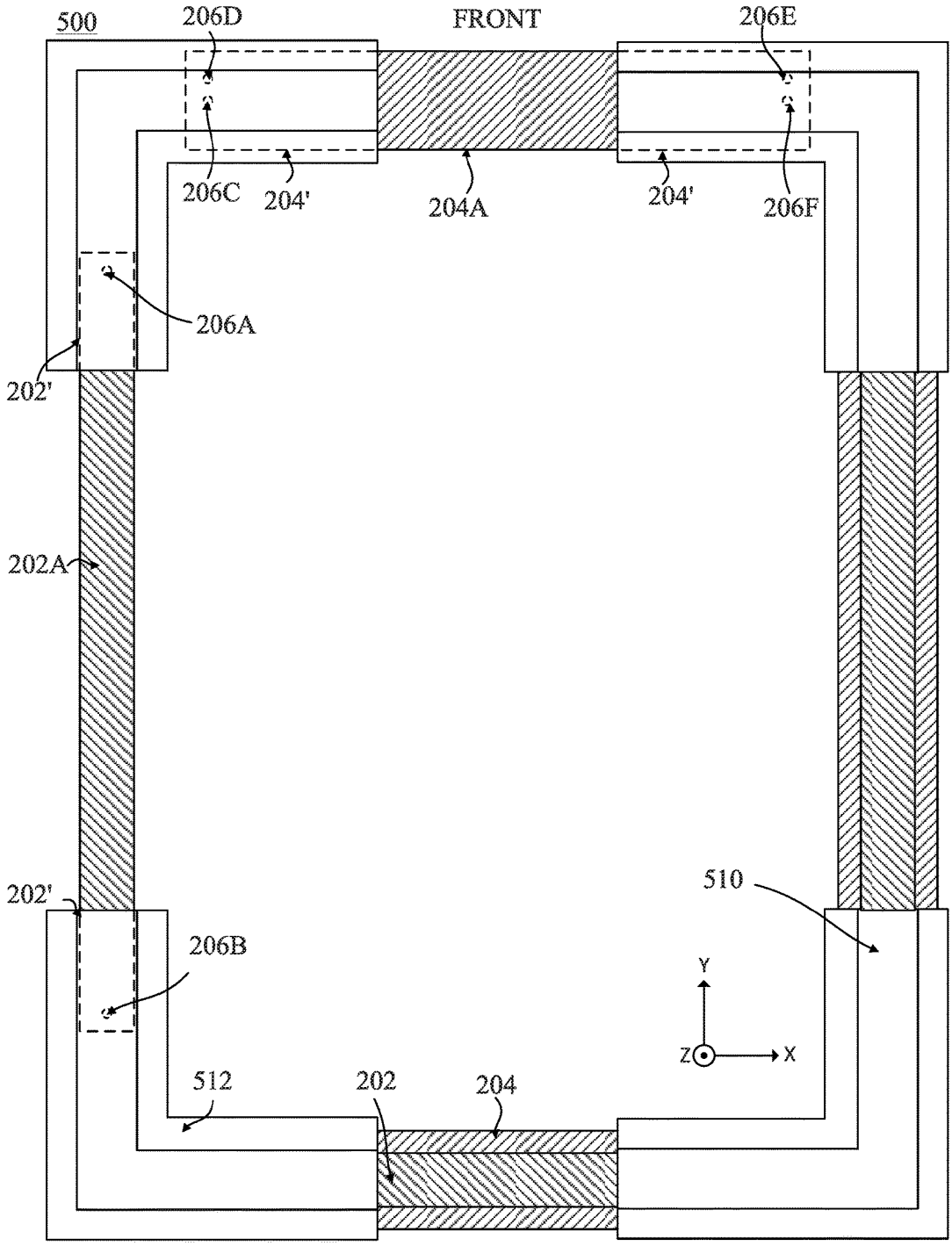
FIGS. 5A-5B illustrates front and back facing views of an exemplary T shaped art frame support system according to examples of the disclosure.
Figure 5B:
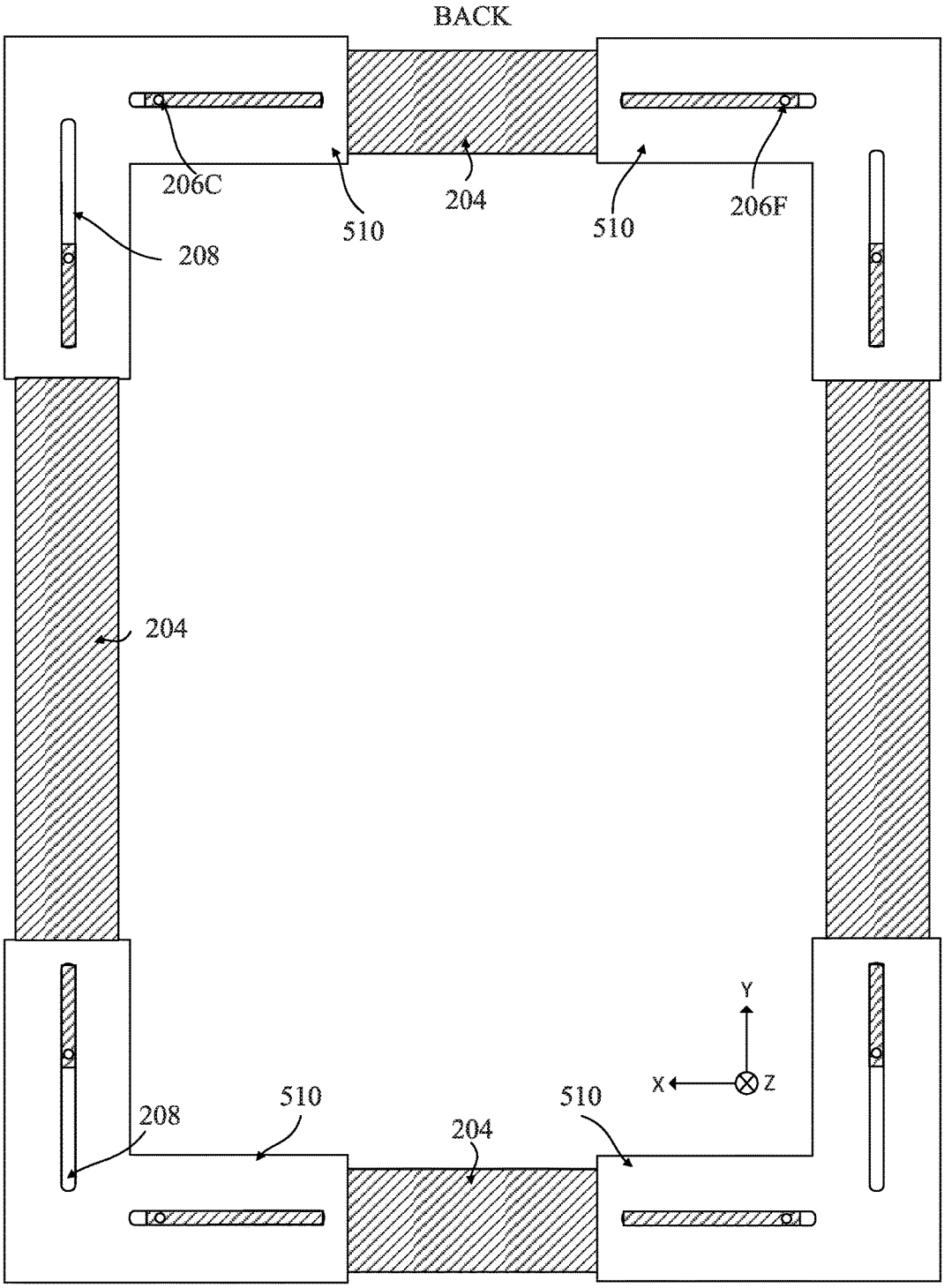

FIGS. 5A-5B illustrate an exemplary art frame support system having T shaped corners 510 according to examples of the disclosure. As illustrated in the figure, art frame 400 includes vertical edge pieces 202 and horizontal edge pieces 204 (which can correspond to edge pieces 202 and 204 in FIGS. 2-4). Corner pieces 510 (which can correspond to a variation of corner pieces 210 above) can be configured to receive edge pieces 202 and 204 within cavities of the corner pieces. In some examples, the corner pieces 510 can include a cavity having a T shaped cross-section (illustrated in greater detail in FIGS. 6 and 8 below). As shown, in some examples, edge pieces 202 and 204 can be arranged to form a T shaped ledge 512 corresponding to the L shaped ledge 212 described above. The edge pieces 202 and 204 can be inserted into the cavity 611 (see FIG. 6) in corner 510. Thus, the same edge pieces 202 and 204 that were used to form an L shaped frame can be used to form a T shaped frame. More generally, the edge pieces 202 and 204 can be reused and reconfigured to form a multitude of frames of different shapes, sizes, and decorative varieties. FIG. 5B illustrates a T shaped configuration wherein fastener attachment points 206C and 206F of horizontal edge pieces 204 align with slots 208 (corresponding to FIG. 2B above). The option to resize and reconfigure the art frame assembly system can reduce wasted materials when a particular frame configuration is no longer needed. For example, an artist can exhibit art works in an art frame having a first configuration (e.g., a rectangular frame with L shape corners 210) and upon selling the art piece, the artist can reconfigure and reuse edge pieces 202 and 204 to exhibit a different piece of art in an art frame having a second configuration (e.g., a square frame with T shape corners 510). This flexibility can save on wasted material, as well as saving on storage space needed to maintain an inventory of varied frames for exhibiting art pieces. Alternatively, using the art frame system of this disclosure, one art piece, photograph, etc. can be displayed in different orientations and decorative varieties.

Figure 6:
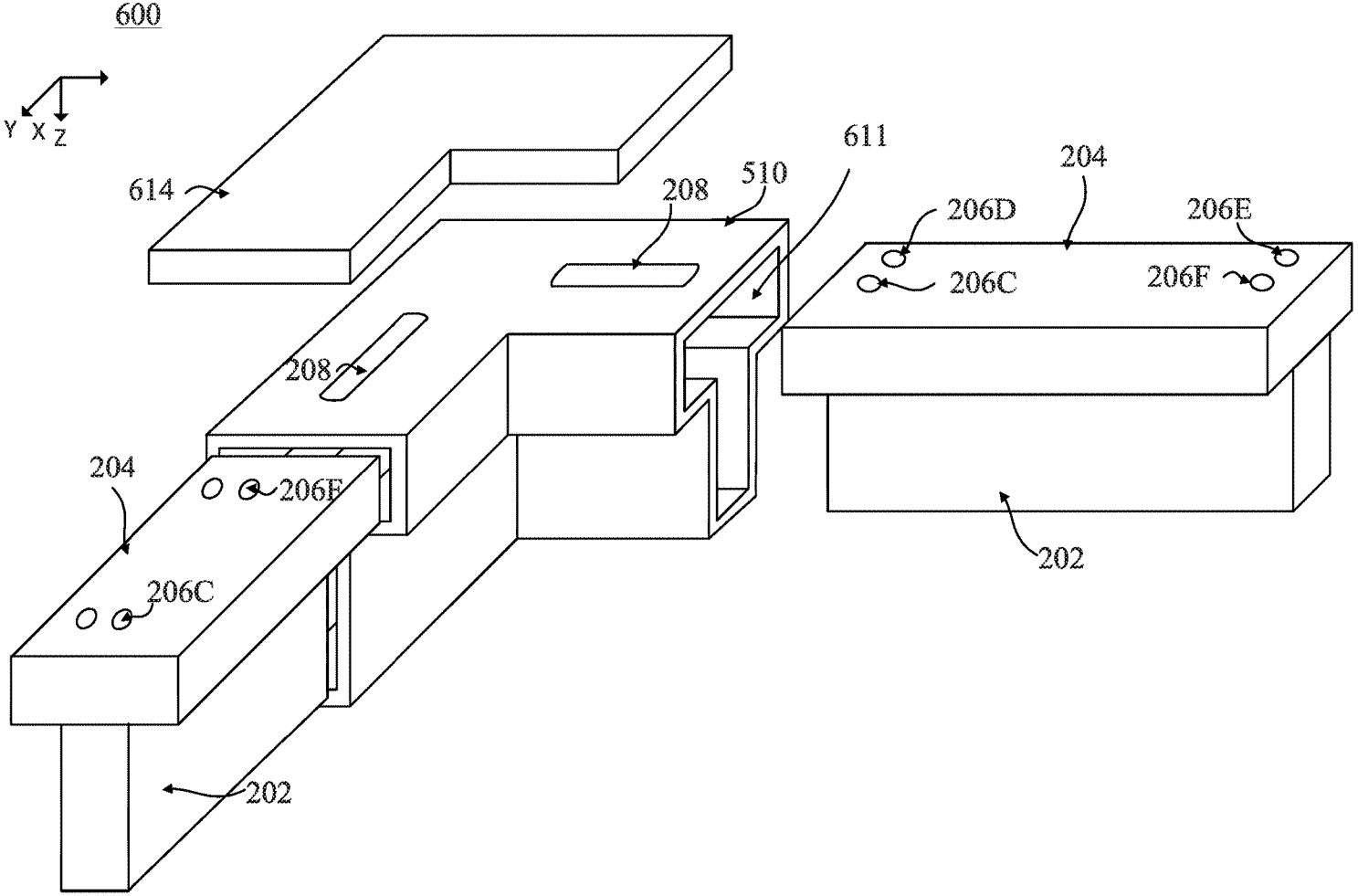
FIG. 6 illustrates an example perspective view of a portion of the exemplary T shaped art frame support system according to examples of the disclosure.

FIG. 6 illustrates a perspective view of art frame support system 600 incorporating T shaped corners according to examples of the disclosure. In some examples, edge pieces 202 and 204 can be inserted into cavities 611 in corner pieces 510. In some examples, slotted openings 208 can be aligned with attachment points 206 (e.g., 206C and 206F) in horizontal edge pieces 204 and through a corresponding attachment points 206 (e.g., 206A and 206B, not shown) in one of the narrow sides of vertical edge pieces 202. In some examples, fasteners, e.g., screws, can be used for fixing the edge pieces 202 and 204 and the corner piece 510 together using the slotted openings 208 and attachment points 206. In some examples, corner caps 614 can be affixed to corner pieces 510 to improve the visual appearance of the art frame by obscuring the fasteners holding the frame together. In some examples, the corner caps 614 can act as decorative covers for the corner pieces (e.g., having patterns printed, engraved, etched, etc. on the exterior surfaces of the corner caps). In some examples, corner caps 614 can snap into grooves on the corner pieces 510. While only one corner piece 510 is shown, it is understood that similar assembly can occur with four corners (or more than four joining pieces as described below in FIG. 10) to form a frame assembly.

Figure 7A:
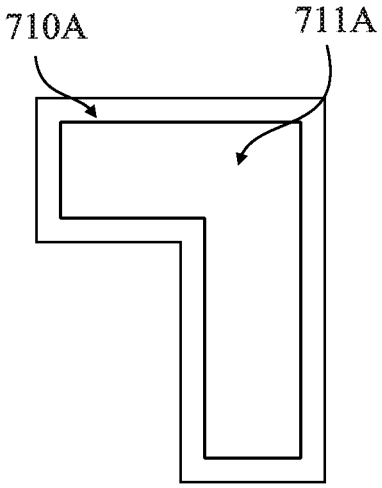
FIGS. 7A-7D illustrate exemplary variations of L shaped corner pieces and corner piece cavity openings for an art frame support system according to examples of the disclosure.
Figure 7B:
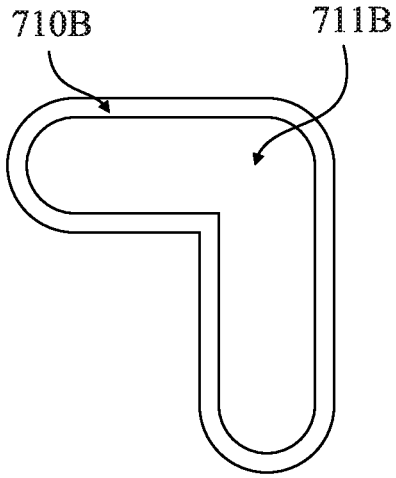
Figure 7C:
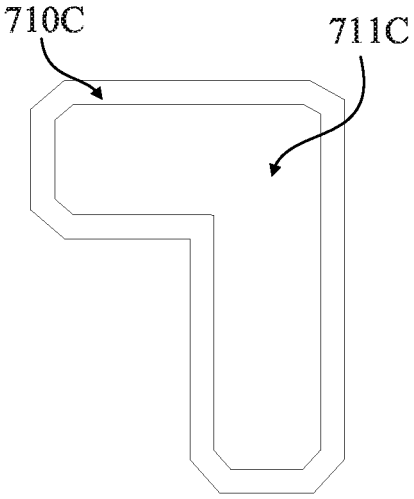
Figure 7D:
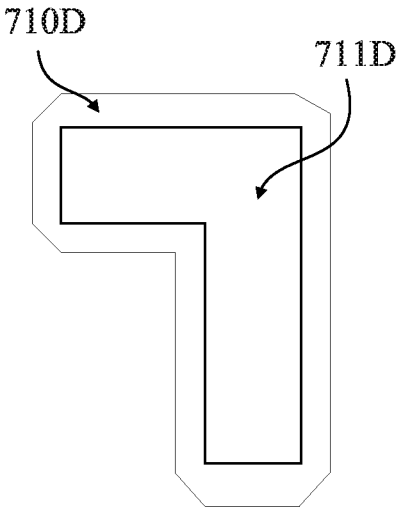
Figure 8A:
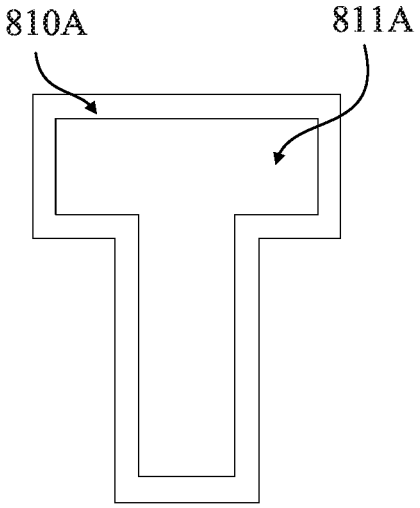
FIGS. 8A-8D illustrate exemplary variations of T shaped corner pieces and corner piece cavity openings for an art frame support system according to examples of the disclosure.
Figure 8B:
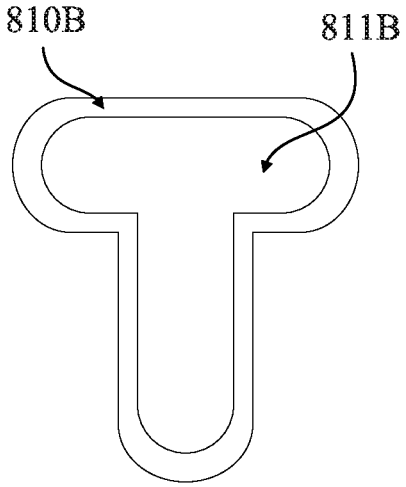
Figure 8C:
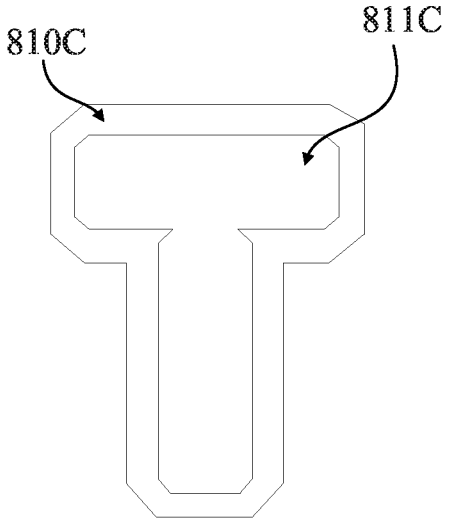
Figure 8D:
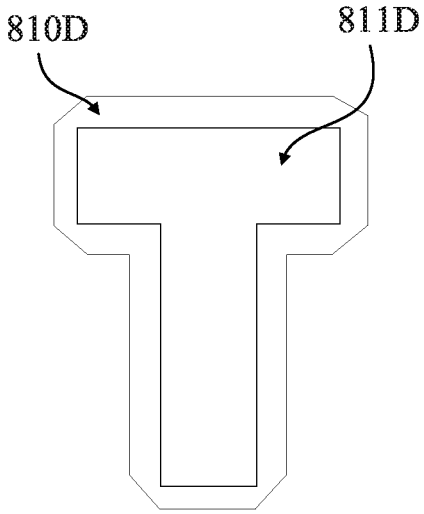

FIGS. 7A-7D illustrate different exemplary variations of L shaped corner pieces 710 (which can correspond to corner pieces 210 above) and corner piece cavity openings 711 of an art frame assembly according to examples of the disclosure. FIG. 7A illustrates an exemplary cross-section wherein the corner piece outer edges 710A and the cavity 711A edges inside the corner piece are squared off. In the corner piece illustrated in FIG. 7A, edge pieces 202 and 204 (e.g., as shown in FIGS. 2-6) having a rectangular cross-section can be inserted into the corner piece 710A to form the L shaped support systems described above. FIG. 7B illustrates an exemplary cross-section wherein the corner piece 710B outer edges and the cavity 711B edges inside the corner piece are rounded, and FIG. 7C illustrates an exemplary cross-section wherein the corner piece 710C outer edges and cavity 711C edges inside the corner piece are cambered. While the corner pieces 710A-C and corresponding cavities 711A-C are illustrated having similar edge shapes, it should be understood that the edge shapes of the cavities 711 do not necessarily have to match with the shapes of the outer edges of the corner pieces 710. For example, FIG. 7D illustrates an exemplary corner piece 710D having cambered outer edges but having square off cavity 711D edges. As should be understood, from the disclosure above, in order for edge pieces 202 and 204 (as shown in FIGS. 2-6) to be inserted into the various cavities 711A-711D, the corresponding shape/size of the edge pieces must be able to fit within the cavities. In some examples, the art frame system can be designed such that all of the various cavity 711 shapes are compatible with edge pieces (e.g., 202 and 204 above) having a rectangular cross section. It should be understood that art frame system can be designed such that the cavities and edge pieces can be interconnected both when the edge pieces 202 and 204 (as shown in FIGS. 2-6) have a cross-section matching the cavity shape (e.g., 711A-711C) and when edge pieces have a cross-section different from the cavity shape. In some examples, different edge piece cross-sections can be used to more completely fill the space in each different cavity shape (e.g., 711A-711C). For example, rectangular edge pieces can fit tightly in the cavities 711A and 711D but may leave gaps if inserted into cavities 711B or 711C. Although such a design for the art system is possible, the disclosure is not limited to an art frame support system design where every edge piece cross-section is compatible with every corner piece outside edge shape (710A-710D) and corner piece cavity shape (711A-711D).

For example, an art frame support system could be designed where rectangular shaped edge pieces can fit in cavities 711A, 711C, and 711D, while not being compatible with cavity 711B.

FIGS. 8A-8D illustrate different exemplary variations of T shaped corner pieces 810 (which can correspond to corner pieces 510 above)and corner piece cavity openings 811 of the art frame assembly having a T shape. Similar to the L shaped art frame assembly and corner pieces described above, cavities 811A-811D inside corner pieces 810A-D can have different edge shapes (e.g., rectangular, rounded, or cambered). Each of these different edge shapes of the cavities 811A-D can be included in corner pieces having outside edges that have the same shape as the cavity edges (e.g., 810A-810C) or can be included in corner pieces having outside edges with a different shape from the cavity edges (e.g., 810D).

Figure 9A:
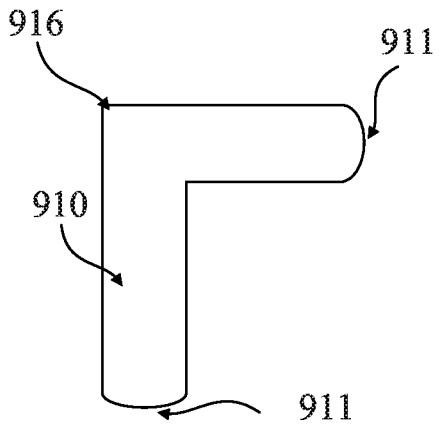
FIGS. 9A-9B illustrate exemplary views of an L shaped corner piece for an art frame support system having rounded edges.
Figure 9B:
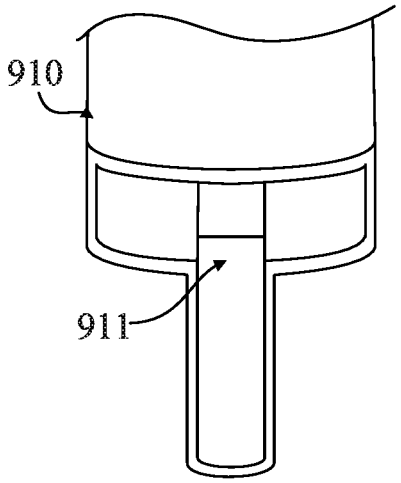

FIGS. 9A-9B illustrate exemplary views of a T shaped corner piece for an art frame support system having curved edges at the location of cavity openings 911 according to examples of the disclosure. FIG. 9A illustrates a top view of the corner piece 910 (which can correspond to corner piece 210 above). The corner piece 910 can be either a T shaped or L shaped corner piece as described in the examples above. In some examples, corners 916 of the corner piece 910 can also be rounded (not shown), thus removing sharp points from all edges of the corner piece. FIG. 9B illustrates an exemplary perspective view of a portion of the T shaped corner piece 910 having the curved edges illustrated in FIG. 9A, and providing a more clear illustration of a face of the corner piece 910. Each cavity 911 opening of the corner piece 910 can have a similarly curved face, providing an aesthetically pleasing decorative appearance. In addition to curved edges, different decorative modifications can be done to the corner pieces 910, such as adding bevels, chamfers, and/or surface designs. As should be understood from the above description, corner pieces 910 having different designs could be used interchangeably with compatible edge pieces to change the visual appearance of the art frame system, while conserving wood (or plastic, metal, etc.) by reusing the sides of the framing system in the various different configurations.

Figure 10A:
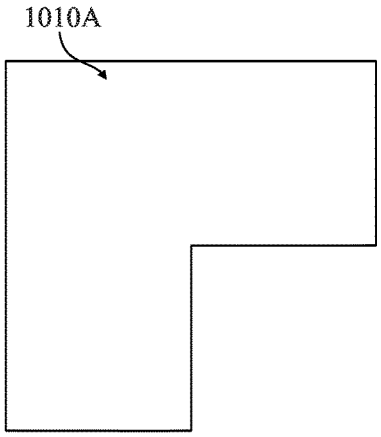
FIGS. 10A-10C illustrate joining pieces for an art framing system having respectively two sides, three sides, and four sides according to examples of the disclosure.
Figure 10B:
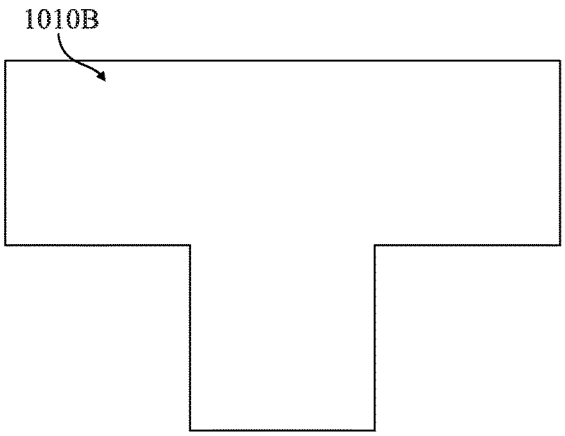
Figure 10C:
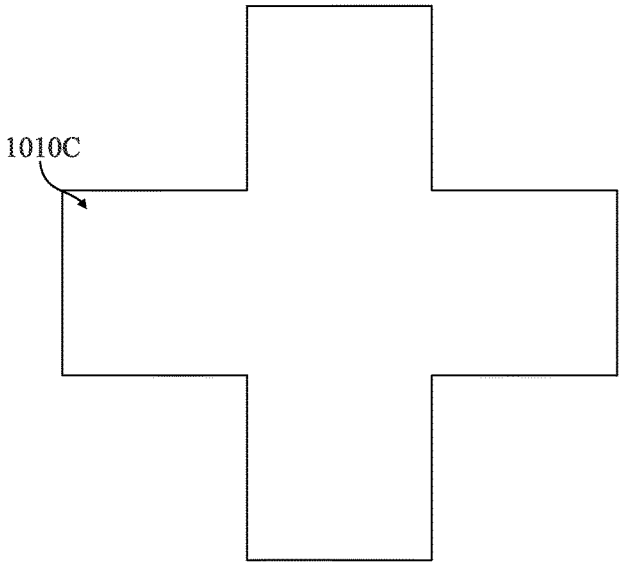

FIGS. 10A-10C illustrate joining pieces 1010A, 1010B, and 1010C for an art framing system (as described above) having respectively two sides (e.g., corner pieces 210, 510 above), three sides, and four sides. Using combinations of different joining pieces 1010A-1010C along with vertical and horizontal edge pieces 202 and 204, more complex frame assembly configurations can be constructed that can hold multiple art pieces (including pieces of different sizes) simultaneously. Cap pieces (not shown) similar to the cap pieces in FIG. 6 can also be provided in the various shapes of the joining pieces for hiding fasteners and/or adding decorative embellishments.

Therefore, according to the above, some examples of the disclosure are directed to a frame assembly system comprising a plurality of joining pieces having a plurality of openings in each joining piece, each of the plurality of openings having a first cross-sectional shape and framing pieces having a second cross-sectional shape, different from the first cross-sectional shape, wherein the first cross-sectional shape can be formed by an arrangement of two or more of the framing pieces, a first one of the two or more framing pieces positioned approximately perpendicular to at least a second one of the two or more framing pieces in the arrangement. Additionally or alternatively to one or more of the examples disclosed above, in some examples, four joining pieces form four corners of a rectangular frame, and at least eight framing pieces form four sides of the rectangular frame. Additionally or alternatively to one or more of the examples disclosed above, in some examples, the first cross-sectional shape is a T shape and the second cross-sectional shape is rectangular. Additionally or alternatively to one or more of the examples disclosed above, in some examples, the first cross-sectional shape is an L shape and the second cross-sectional shape is rectangular. Additionally or alternatively to one or more of the examples disclosed above, in some examples, the frame assembly system further comprises a plurality of second joining pieces having a plurality of openings in each second joining piece, each of the plurality of openings in the second joining pieces having a third cross-sectional shape, different from the first and second cross-sectional shapes, wherein the third cross-sectional shape can be formed by a second arrangement of two or more of the framing pieces, the first one of the two or more framing pieces positioned approximately perpendicular to at least the second one of the two or more framing pieces in the second arrangement. Additionally or alternatively to one or more of the examples disclosed above, in some examples, the first cross-sectional shape is a T shape and the third cross-sectional shape is an L shape. Additionally or alternatively to one or more of the examples disclosed above, in some examples, the framing pieces have a rectangular cross-section with rounded corners. Additionally or alternatively to one or more of the examples disclosed above, in some examples, the frame assembly system further comprises a fastener for coupling at least one of the framing pieces to at least one of the joining pieces and a cap piece couplable to at least the at least one joining piece and configured to conceal the fastener.

Some examples of the disclosure are directed to a frame assembly comprising a first corner piece having a first opening and a second opening having a first shape, a first edge piece configured to operatively couple with a first portion of the first opening, the first edge piece having a second shape, a second edge piece configured to operatively couple with a second portion of the first opening, the second edge piece having a third shape, wherein the first edge piece and the second edge piece can be operatively coupled to form a combined edge piece having the first shape, the combined edge piece configured to operatively couple with the first and second portions of the first opening. Additionally or alternatively to one or more of the examples disclosed above, in some examples, the first edge piece comprises a first fastener attachment point at a first distal end and a second fastener attachment point at a second distal end and the second edge piece comprises a plurality of fastener attachment points, capable of being aligned with the first and second fastener attachment points of the first edge piece. Additionally or alternatively to one or more of the examples disclosed above, in some examples, the frame assembly further comprises a fastener attachment point for coupling the first edge piece and the second edge piece with a fastener to form the combined edge piece. Additionally or alternatively to one or more of the examples disclosed above, in some examples, the combined cross-sectional shape is a T shape or L shape. Additionally or alternatively to one or more of the examples disclosed above, in some examples, the combined edge piece can be inserted into the first opening. Additionally or alternatively to one or more of the examples disclosed above, in some examples, the second shape and the third shape are different. Additionally or alternatively to one or more of the examples disclosed above, in some examples, the frame assembly further comprises a cap piece couplable to the at least one joining piece and configured to conceal the fastener.

Some examples of the disclosure are directed to a corner piece for a frame assembly comprising a first opening of the corner piece facing a first direction and a second opening of the corner piece facing a second direction, orthogonal to the first direction and a cavity connecting the first opening and the second opening, the corner piece configured to receive a first edge piece at the first opening, and receive a second edge piece at the second opening. Additionally or alternatively to one or more of the examples disclosed above, in some examples, the edge pieces each have a first cross-sectional shape, and the first and second openings each have a second cross-sectional shape, different from the first cross-sectional shape. Additionally or alternatively to one or more of the examples disclosed above, in some examples, the first cross-sectional shape is a rectangular shape, and the second cross-sectional shape is an L shape. Additionally or alternatively to one or more of the examples disclosed above, in some examples, the first cross-sectional shape is a rectangular shape, and the second cross-sectional shape is a T shape. Additionally or alternatively to one or more of the examples disclosed above, in some examples, the corner piece further comprises a cap piece couplable to an exterior surface of the corner piece and configured to conceal fastener attachment points in the corner piece.

Although examples of this disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

What is claimed is:

1. A frame assembly system comprising:

a plurality of joining pieces having a plurality of openings in each joining piece, each of the plurality of openings having a first cross-sectional shape, wherein the plurality of joining pieces form corners of the frame assembly when assembled with a plurality of framing pieces; and the plurality of framing pieces having a second cross-sectional shape, different from the first cross-sectional shape, wherein the first cross-sectional shape can be formed by an arrangement of two or more of the framing pieces, a first one of the two or more framing pieces positioned approximately perpendicular to at least a second one of the two or more framing pieces in the arrangement, wherein the framing pieces, when arranged to form the first cross-sectional shape, are inserted into respective openings of the joining pieces to form sides of the frame assembly.

2. The frame assembly system of claim 1, wherein four joining pieces form four corners of a rectangular frame, and at least eight framing pieces form four sides of the rectangular frame.

3. The frame assembly system of claim 1, wherein the first cross-sectional shape is a T shape and the second cross-sectional shape is rectangular.

4. The frame assembly system of claim 1, wherein the first cross-sectional shape is an L shape and the second cross-sectional shape is rectangular.

5. The frame assembly system of claim 1 further comprising:

a plurality of second joining pieces having a plurality of openings in each second joining piece, each of the plurality of openings in the second joining pieces having a third cross-sectional shape, different from the first and second cross-sectional shapes, wherein the third cross-sectional shape can be formed by a second arrangement of two or more of the framing pieces, the first one of the two or more framing pieces positioned approximately perpendicular to at least the second one of the two or more framing pieces in the second arrangement.

6. The frame assembly system of claim 5, wherein the first cross-sectional shape is a T shape and the third cross-sectional shape is an L shape.

7. The frame assembly system of claim 3, wherein the framing pieces have a rectangular cross-section with rounded corners.

8. The frame assembly system of claim 1, further comprising:

a fastener for coupling at least one of the framing pieces to at least one of the plurality of joining pieces; and a cap piece couplable to at least the at least one joining piece of the plurality of joining pieces and configured to conceal the fastener.

9. A frame assembly comprising:

a first corner piece having a first opening and a second opening having a first shape;

a first edge piece configured to operatively couple with a first portion of the first opening, the first edge piece having a second shape;

a second edge piece configured to operatively couple with a second portion of the first opening, the second edge piece having a third shape;

a third edge piece configured to operatively couple with a first portion of the second opening, the third piece having the second shape; and a fourth edge piece configured to operatively couple with a second portion of the second opening, the fourth edge piece having the third shape;

wherein the first edge piece and the second edge piece can be operatively coupled to form a combined edge piece having the first shape, the combined edge piece configured to operatively couple with the first and second portions of the first opening, and the third edge piece and the fourth edge piece can be operatively coupled to form a second combined edge piece having the first shape, the second combined edge piece configured to operatively couple with the first and second portions of the second opening.

10. The frame assembly of claim 9 wherein:

the first edge piece comprises a first fastener attachment point at a first distal end and a second fastener attachment point at a second distal end; and the second edge piece comprises a plurality of fastener attachment points, capable of being aligned with the first and second fastener attachment points of the first edge piece.

11. The frame assembly of claim 10 further comprising:

the first fastener attachment point configured for coupling the first edge piece and the second edge piece with a fastener to form the combined edge piece.

12. The frame assembly of claim 11, wherein the first shape is a T shape or L shape.

13. The frame assembly of claim 9, wherein the combined edge piece can be inserted into the first opening.

14. The frame assembly of claim 9, wherein the second shape and the third shape are different.

15. The frame assembly of claim 11, further comprising:

a cap piece couplable to the at least one joining piece and configured to conceal the fastener.

* * * * *